US008800450B2

(12) United States Patent
Heitmann et al.

(10) Patent No.: US 8,800,450 B2
(45) Date of Patent: Aug. 12, 2014

(54) PROJECTILE FASTENING BOLT FOR A SHELL WITH A SUBCALIBER PENETRATOR WITH A CONICAL TAILPIECE AND A SHELL

(75) Inventors: Thomas Heitmann, Unterluess (DE); Klaus-Dieter Freudenthal, Suderburg (DE); Michael Vagedes, Hermannsburg (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 226 days.

(21) Appl. No.: 12/567,188

(22) Filed: Sep. 25, 2009

(65) Prior Publication Data

US 2010/0077934 A1 Apr. 1, 2010

Related U.S. Application Data

(60) Provisional application No. 61/199,833, filed on Nov. 20, 2008.

(30) Foreign Application Priority Data

Sep. 26, 2008 (DE) ..... 10 2008 049 147

(51) Int. Cl.
*F42B 14/06* (2006.01)

(52) U.S. Cl.
USPC ..... 102/522

(58) Field of Classification Search
USPC ..... 102/520, 521, 522, 523, 473
See application file for complete search history.

(56) References Cited

U.S. PATENT DOCUMENTS 4,043,269 A * 8/1977 Ambrosini ..... 102/513
5,481,981 A * 1/1996 Sippel et al. ..... 102/522

* cited by examiner

*Primary Examiner* — Gabriel Klein
(74) *Attorney, Agent, or Firm* — Lucas & Mercanti, LLP; Klaus P. Stoffel

(57) ABSTRACT

A shell with a subcaliber penetrator, which has a conical tailpiece, and with a basically disk-shaped propulsion element, wherein the conical tailpiece has a frustum-shaped recess that is open towards the rear end. The propulsion element is joined with the penetrator, preferably by a screw connection (projectile fastening bolt). To this end, a bolt element joins the propulsion element and the penetrator in the area of the tailpiece and has a borehole that is open at the rear end, into which propellant charge gases flow when the shell is fired and cause rending of the bolt element and thus separation of the propulsion element from the penetrator.

14 Claims, 3 Drawing Sheets

PROJECTILE FASTENING BOLT FOR A SHELL WITH A SUBCALIBER PENETRATOR WITH A CONICAL TAILPIECE AND A SHELL

This application is a conventional application of Provisional Application No. U.S. 61/199,833 filed Nov. 20, 2008, which in turn claims the priority of DE 10 2008 049 147.0 filed Sep. 26, 2008, the priority of both applications is hereby claimed and both applications are incorporated by reference herein

BACKGROUND OF THE INVENTION

The invention concerns a shell with a subcaliber penetrator, which has a conical tailpiece, and with a basically disk-shaped propulsion element, wherein the conical tailpiece has a frustum-shaped recess that is open towards the rear end. The invention especially concerns a so-called projectile fastening bolt for such a shell.

A shell of this type is disclosed, for example, by DE 43 30 417 C2. In this projectile, the rear-end of the tailpiece is supported on a propulsion element, which consists of a metal plate, which basically has the contour of the frustum-shaped recess of the tailpiece.

In practice, it has been found that play can develop between the propulsion clement and the conical tailpiece just from normal handling of the shell, so that after discharge, at the beginning of the buildup of gas pressure in the gun barrel, propellant charge gases flow under the contact area of the conical tailpiece. This has two adverse effects. First, optimal acceleration of the penetrator within the gun barrel is prevented, and, second, disturbances of the penetrator by the propulsion element can occur after it has left the gun barrel.

SUMMARY OF THE INVENTION

The present invention provides a shell, in which the propulsion element is joined with the penetrator without play both during normal handling of the shell and upon discharge, and in which the propulsion element separates from the penetrator without any trouble after leaving the gun barrel.

The basic idea of the invention is to join the propulsion element, not by a form-locking joint or compression joint, as in comparable prior-art shells, but rather by a projectile fastening bolt, preferably with a rated break point and pressure-reducing nozzles, wherein a bolt element is provided, which is passed through the frustum-shaped recess of the conical tailpiece and joins the propulsion element with the penetrator. In this regard, the bolt element has a borehole that is open at the rear end, into which propellant charge gases flow when the shell is fired. The bolt element is designed in such a way that the internal pressure that develops in the borehole due to the propellant charge gases leads to the rending of the bolt element and thus to the separation of the propulsion element from the penetrator.

In a first embodiment of the invention, the bolt element comprises a first subelement, whose front end has an internal thread, which screws together axially with the external thread of a second subelement, which in turn is joined with the rear wall of the tailpiece, which bounds the tailpiece at the front end. In this connection, a second subelement can be a tracer cup provided with an external thread.

The first subelement of the bolt element preferably has a bolt-shaped design and consists of a head part and a shaft part. The shaft part is passed through a borehole of the propulsion element into the frustum-shaped recess and screwed together with the second subelement. The head part projects laterally beyond the borehole of the propulsion element at the rear end and is supported on the rear-end surface of the propulsion element.

However, the first subelement of the bolt clement can also have a multisectional design and can comprise a cup-shaped fastening part for screwing onto the tracer cup and a screw bolt provided with a through-hole. The screw bolt has a bolt head and a shaft provided with an external thread. The shaft is supported in such a way in a threaded borehole that passes through the propulsion element that the end of the shaft that faces away from the bolt head can be turned from the rear-end surface of the propulsion element and that the bolt head is nonrotatably supported in a recess of the cup-shaped fastening part.

In another embodiment of the invention, the propulsion element is connected with a bolt-shaped bolt element, which projects axially into the frustum-shaped recess and is screwed directly into an internal thread of the rear wall of the penetrator.

To ensure good centering of the conical tailpiece with respect to the propulsion element, it has been found to be advantageous if the end of the propulsion element that faces the tailpiece of the penetrator has a recess for the form-locking reception of the rear-end region of the tailpiece.

The propulsion element preferably consists of a light metal, for example, an aluminum or magnesium alloy, but it can also be made of steel. It can be used for accelerating both subcaliber artillery shells and subcaliber training shells.

The design described above not only is cost-effective but also functions very well. It is stable with respect to both temperature and stress and is distinguished by simple fabrication without assembly tools. In addition, the tailpiece internal gas pressure can be adjusted in such a way that the maximum internal gas pressure that develops in the end of the tailpiece can be adjusted with the diameter of the hollow borehole and with the ratio of the initial high volume in the bolt to the final volume in the tailpiece region. At the same time, the gases flowing in can ignite a tracer that may be present.

Further details and advantages of the invention are described with reference to the specific embodiments illustrated in the drawings.

DETAILED DESCRIPTION OF THE INVENTION

Figure 1:
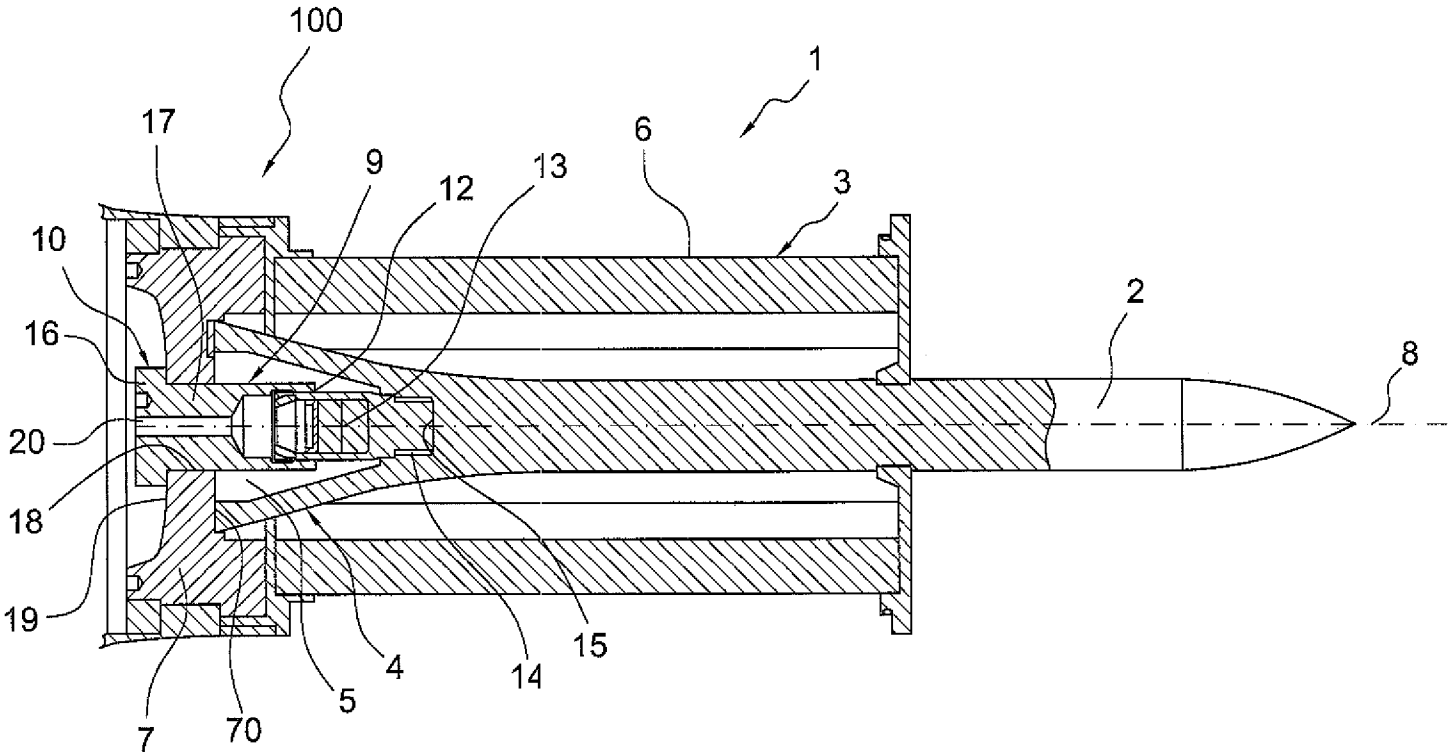
FIG. 1 shows a longitudinal section through a first embodiment of a shell of the invention with a bolt element that connects a penetrator and a propulsion element.

FIG. 1 shows a shell 1, which, for example, is a 120-mm training shell that can be fired from a tank gun. The shell 1 comprises a subcaliber penetrator 2, which, for example, is made of steel, and a sabot 3 that partially encloses the penetrator 2. The penetrator 2 has a conically shaped tailpiece (conical tailpiece) 4 at its rear end with a frustum-shaped recess 5.

The sabot 3 basically consists of an essentially hollow cylindrical guide cage 6, which consists of two half shells (sabot segments) made of glass-fiber reinforced plastic, and a propulsion element 7, which is connected to the rear side of the guide cage 6.

The propulsion element 7 is formed by a disk-shaped metal plate that extends transversely to the longitudinal axis 8 of the shell 1 and consists, for example, of an aluminum alloy. In this regard, the end of the disk-shaped propulsion element 7 that faces the tailpiece 4 of the penetrator 2 has a recess 70 for the form-locking reception of the rear-end region of the tailpiece 4 whereby only an axial end face and an outer peripheral surface of the tailpiece 4 contact the propulsion element 7 without play and without gaps. Furthermore, there is no surface contact between the propulsion element 7 and the inner surfaces of the tailpiece 4.

Figure 2:
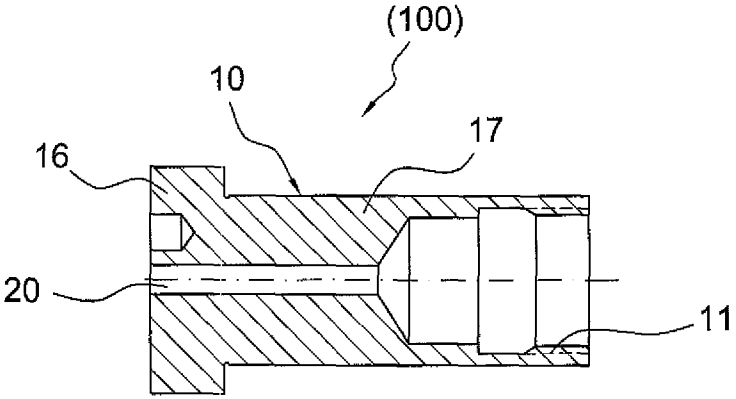
FIG. 2 shows an enlarged view of a first subelement 10 of the bolt element from FIG. 1.

In accordance with the invention, the propulsion element 7 is connected with the penetrator 2 by a so-called projectile fastening bolt 100, especially a screw connection. To this end, a bolt element 9 is provided, which preferably consists of metal. The bolt element 9 comprises a first subelement 10, which has an internal thread 11 at its front end (FIG. 2) and is axially screwed together with an external thread 12 of a second subelement 13. The second subelement 13 is a tracer cup with an external thread. The end of the tracer cup which faces away from the first subelement 10 is screwed into an internal thread 14 of the rear wall 15 of the tailpiece 4.

The first subelement 10 has a bolt-shaped design and consists of a head part 16 and a shaft part 17. The shaft part 17 is passed through a borehole 18 of the propulsion clement 7 into the frustum-shaped recess 5 of the tailpiece 4 and screwed together with the tracer cup 13. The head part 16 projects laterally beyond the borehole 18 of the propulsion element 7 and is supported on the rear-end surface 19 of the propulsion element 7.

In addition, the first subelement 10 has a borehole 20 that is open at the rear end, into which propellant charge gases can flow when the shell 1 is fired. The bolt element 9 is designed in such a way that the internal pressure that develops in the borehole 20 due to the propellant charge gases leads to the rending of the bolt element 9 (for example, along rated break points, which are not shown in the drawings) and thus to the separation of the propulsion element 7 from the penetrator 2. After the separation process, the penetrator 2 rests freely on the propulsion element 7 and can become detached from the propulsion element 7 without any problem when it leaves the gun barrel.

At the same time, a tracer possibly present in the tracer cup 13 can be ignited by the propellant charge gases flowing into the frustum-shaped recess 5.

Figure 3:
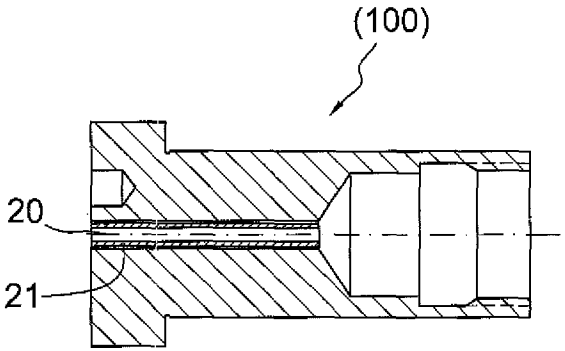
FIG. 3 shows another embodiment of a first subelement in the same view as in FIG. 2.

As FIG. 3 shows, the diameter of the borehole 20 and thus the maximum internal pressure of the propellant charge gases in the area of the end of the tailpiece can be adjusted by inserts 21 (for example, a setscrew provided with a borehole) screwed into the first subelement 10.

Figure 4:
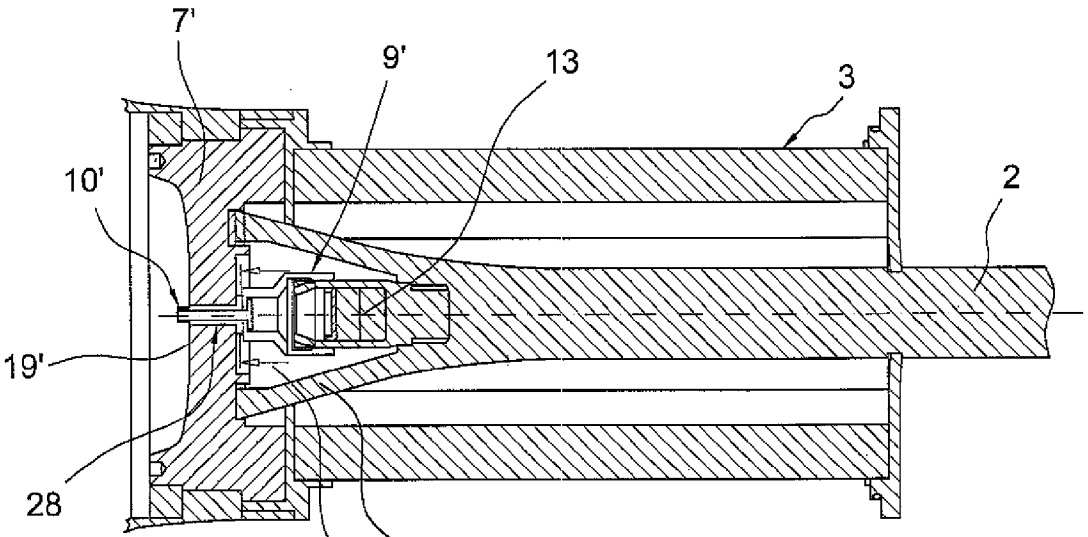
FIG. 4 shows a longitudinal section through a second embodiment of a shell of the invention.
Figure 5:
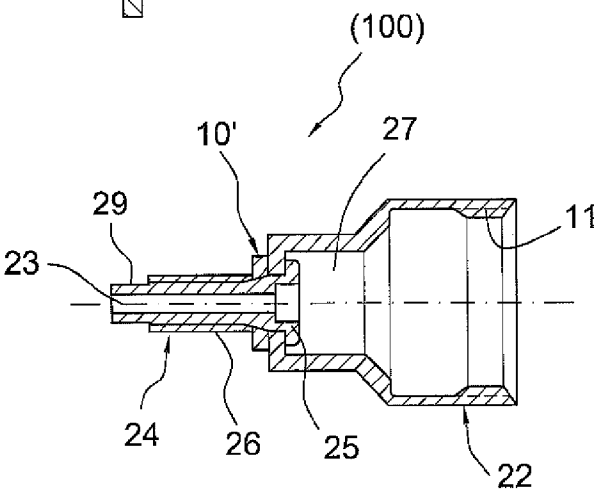
FIG. 5 shows an enlarged view of a first subelement, which is identified by 10' in FIG. 4.

FIGS. 4 and 5 show a second embodiment of the invention, in which the penetrator 2 is frictionally connected with a propulsion element 7' by means of a bolt clement 9'. The bolt element likewise comprises two subelements 10' and 13, of which the second subelement 13 is likewise a tracer cup with an external thread.

In this embodiment, the first subelement 10' has a multisectional design and basically consists of a cup-shaped fastening part 22 for screwing onto the tracer cup 13 and a screw bolt 24 with a through-hole 23. The screw bolt 24 consists of a bolt head 25 and a shaft 26 with an external thread. In this regard, the bolt head 25 is nonrotatably supported in a recess 27 of the cup-shaped fastening part 22 and is supported on the inside wall of the recess 27 with its end that faces the shaft 26.

The shaft 26 of the screw bolt 24 is supported in a threaded borehole 28 that passes axially through the propulsion element 7'. The end 29 of the shaft 26 that faces away from the bolt head 25 is formed as a square, so that the shaft 26 can be turned from the rear-end surface 19' of the propulsion element 10'.

Naturally, the invention is not limited to the embodiments described above. For example, it is not absolutely necessary for the bolt element to consist of two subelements, but rather it can be provided that it can either be screwed directly into a thread in the rear wall of the tailpiece or be screwed onto a pin-like extension of the rear wall.

Although the present invention has been described in relation to particular embodiments thereof, many other variations and modifications and other uses will become more apparent to those skilled in the art. It is preferred, therefore, that the present invention be limited not by the specific disclosure herein, but only by the appended claims.

The invention claimed is:

1. A shell comprising:

a subcaliber penetrator, which has a conical tailpiece;

a propulsion element, wherein the conical tailpiece has a frustum-shaped recess that is open towards a rear end; and a projectile fastening bolt, the fastening bolt comprising a bolt element that axially connects the penetrator to the propulsion element and has a borehole that is open at a rear end, into which borehole propellant charge gases flow when the shell is fired so that internal pressure that develops in the borehole due to the propellant charge gases leads to a rending of the bolt element and thus to separation of the propulsion element from the penetrator, wherein the bolt element comprises a first subelement for connection with a borehole in the propulsion element, contains the borehole that is open at the rear end, has an internal thread at a front end, and screws together axially with an external thread of a second subelement wherein only an axial end face and an outer peripheral surface of the tailpiece contact the propulsion element, and wherein the tailpiece contacts the propulsion element without play.

2. A projectile fastening bolt in accordance with claim 1, wherein the first subelement comprises an axially extending insert, which contains the borehole that is open at the rear end, has an external thread, and is threadable into a corresponding threaded borehole of the first subelement.

3. A projectile fastening bolt in accordance with claim 1, wherein the first subelement of the bolt element comprises a head part and a shaft part.

4. A projectile fastening bolt in accordance with claim 1, wherein the first subelement of the bolt element comprises a cup-shaped fastening part for screwing onto the second subelement and a screw bolt, which has a through-hole, a bolt head, and a shaft with an external thread.

5. A shell comprising: a subcaliber penetrator, which has a conical tailpiece; a propulsion element, wherein the conical tailpiece has a rearwardly open frustum-shaped recess, wherein all inner surfaces of the conical tailpiece have no surface contact with the propulsion element; and a projectile fastening bolt comprising a bolt element that has a borehole that axially connects the penetrator to the propulsion element and is open at a rear end, into which borehole propellant charge gases flow when the shell is fired so that internal pressure that develops in the borehole due to the propellant charge gases leads to a rending of the bolt element and thus to separation of the propulsion element from the penetrator, wherein the bolt element is passed through the frustum-shaped recess and joins the propulsion element and a rear wall of the penetrator, which rear wall borders a front end of the tailpiece.

6. A shell in accordance with claim 5, wherein the bolt element comprises a first subelement that is connected with the propulsion element, contains the borehole that is open at the rear end, has an internal thread at the front end, and screws together axially with an external thread of a second subelement.

7. A shell in accordance with claim 6, wherein the second subelement is connected with the rear wall of the penetrator.

8. A shell in accordance with claim 6, wherein the second subelement is a tracer cup with an external thread.

9. A shell in accordance with claim 6, wherein the first subelement of the bolt element comprises a head part and a shaft part, wherein the shaft part is passed through a borehole of the propulsion element into the frustum-shaped recess and screwed together with the second subelement and the head part projects laterally beyond the borehole of the propulsion element and is supported on a rear-end surface of the propulsion element.

10. A shell in accordance with claim 6, wherein the first subelement of the bolt element comprises a cup-shaped fastening part for screwing onto the second subelement and a screw bolt, which has a through-hole, a bolt head, and a shaft with an external thread, wherein the shaft is supported in a threaded borehole that passes through the propulsion element so that an end of the shaft that faces away from the bolt head is turnable from a rear-end surface of the propulsion element, the bolt head being nonrotatably supported in a recess of the cup-shaped fastening part that faces the bolt element.

11. A shell in accordance with claim 5, wherein the bolt element projects axially into the frustum-shaped recess and is screwed into an internal thread of the rear wall of the penetrator that bounds the recess.

12. A shell in accordance with claim 5, wherein an end of the propulsion element that faces the tailpiece of the penetrator has a recess for form-locking reception of a rear-end region of the tailpiece.

13. A shell in accordance with claim 5, wherein the propulsion element is made of metal.

14. A shell in accordance with claim 5, wherein the propulsion element is substantially external to the conical tailpiece.

* * * * *